US006318919B1

(12) United States Patent
Urso et al.

(10) Patent No.: US 6,318,919 B1
(45) Date of Patent: Nov. 20, 2001

(54) PRESSURE DEVICE FOR PRINTERS

(75) Inventors: Paolo Urso; Fiorino Maggi, both of Milan; Rinaldo Fiore; Giuseppe Boero, both of Turin, all of (IT)

(73) Assignee: Compuprint S.p.A., Turin (IT)

( * ) Notice: Subject to any disclaimer, the term of this patent is extended or adjusted under 35 U.S.C. 154(b) by 0 days.

(21) Appl. No.: 09/399,690

(22) Filed: Sep. 21, 1999

(30) Foreign Application Priority Data

Sep. 21, 1998 (EP) ..... 98830547

(51) Int. Cl.[7] ..... B41J 13/10
(52) U.S. Cl. ..... 400/645; 400/645.1
(58) Field of Search ..... 400/247, 248, 400/622, 645, 645.1, 645.3, 645.4, 645.5

(56) References Cited

U.S. PATENT DOCUMENTS 869,547 * 10/1907 Buckwell ..... 400/248
5,102,247 * 4/1992 Nagoshi et al. ..... 400/642
5,186,556 * 2/1993 Koyanagi ..... 400/642
5,699,815 * 12/1997 Furukawa ..... 132/279
5,823,695 * 10/1998 Bock ..... 400/642

* cited by examiner

*Primary Examiner*—Daniel J. Colilla
(74) *Attorney, Agent, or Firm*—Akin, Gump, Strauss, Hauer & Feld, L.L.P.

(57) ABSTRACT

In a pressure device for a printer comprising a support element which can be fixed to a frame of the printer and a flexible plate fixed to the support element in order to press a printing substrate against a platen in the vicinity of a printing line, the support element includes a turned-over portion bent onto a remaining portion of the support element in order to restrain a portion of the flexible plate.

14 Claims, 4 Drawing Sheets

PRESSURE DEVICE FOR PRINTERS

FIELD OF THE INVENTION

The present invention relates to a pressure device for a printer.

BACKGROUND OF THE INVENTION

In printers of various types such as, for example, serial dot-matrix printers, a printing head acts on a sheet of paper which bears on a platen typically constituted by a roller. The sheet of paper is held tightly against the platen in the vicinity of a printing line by means of a suitable pressure device. This prevents the sheet of paper from vibrating, ensuring good print quality and a low noise level; the pressure device also facilitates the movement of the sheet of paper towards the printing line.

A known pressure device is constituted by a support plate which is anchored to a frame of the printer. A flexible plate is glued to the support plate, generally by means of a two-part adhesive. A free end of the flexible plate, which extends substantially along the entire printing line, is pressed against the platen to keep the sheet of paper fitting tightly.

A disadvantage of these pressure devices is that the method of producing them is quite complex. In particular, the support plate has to be degreased and cleaned with suitable solvents beforehand and then completely dried; moreover, the gluing of the flexible plate requires operations which cannot be automated and which have to be performed manually. The method is therefore extremely slow and expensive and this is reflected in the final cost of the pressure device and hence also of the printer as a whole.

Moreover, the use of glues and solvents makes the method of producing the pressure device highly polluting.

Known pressure devices also have durability problems, since the fairly large forces which act on the flexible plate in a condition of use may cause the flexible plate to be detached from the support plate.

SUMMARY OF THE INVENTION

It is an object of the present invention to overcome the aforementioned drawbacks. To achieve this object, there is proposed a pressure device for a printer comprising a support element which can be fixed to a frame of the printer and a flexible plate fixed to the support element in order to press a printing substrate against a platen in the vicinity of a printing line, in which the support element includes a turned-over portion which is bent onto a remaining portion of the support element in order to restrain a portion of the flexible plate.

The present invention also proposes a printer comprising the pressure device and a corresponding method of producing the pressure device.

BRIEF DESCRIPTION OF THE DRAWINGS

Further characteristics and the advantages of the pressure device for a printer according to the present invention will become clear from the following description of a preferred embodiment thereof, given by way of non-limiting example, with reference to the appended drawings, in which.

DETAILED DESCRIPTION OF THE PREFERRED EMBODIMENT

Figure 1:
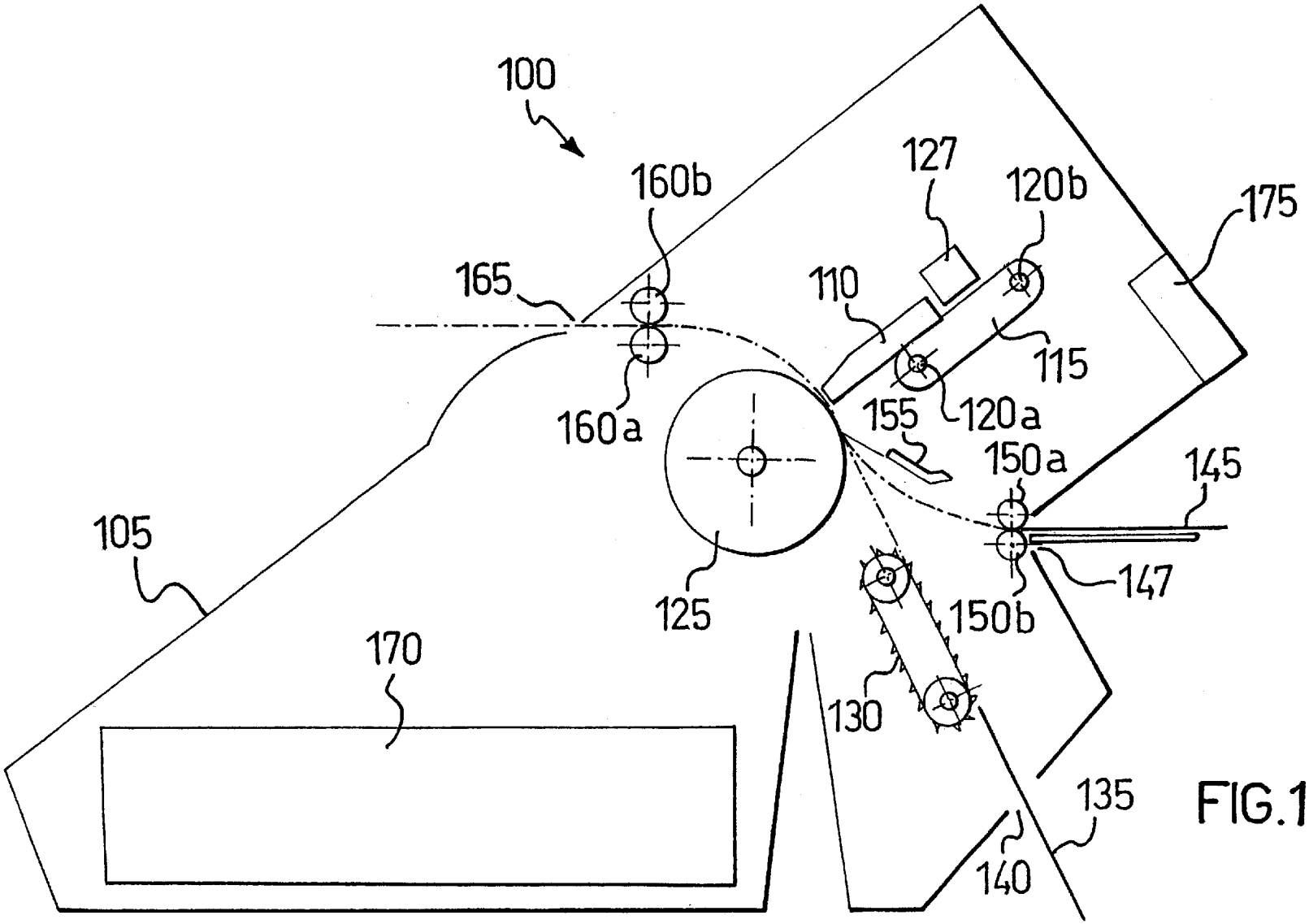
FIG. 1 shows schematically and in section a printer in which the pressure device of the present invention can be used.

With reference in particular to FIG. 1, this shows a serial dot-matrix printer 100 with a mechanical support frame 105. Inside the frame 105 there is a printing head 110 with a matrix of pins (not shown in the drawing). The head 110 is supported by a carriage 115 slidable on two guide bars 120*a* and 120*b*.

The pins of the head 110 face a platen roller 125 parallel to the guide bars 120*a*, 120*b*. A cartridge of inked ribbon 127 is arranged in a manner such that a portion of the inked ribbon is interposed between the pins of the head 110 and the platen 125. The movement of the head 110 defines a printing line on a lateral surface of the platen 125. Similar considerations apply if a flat printing platen or any other equivalent platen element is provided.

A pair of tractor feed devices 130 (of which only one is shown in the drawing, disposed in the vicinity of the longitudinal ends of the platen 125 supply a continuous paper module (fanfold) 135 inserted through a slot 140, towards the printing line (perpendicularly thereto). A single sheet 145 is inserted manually through a further slot 147 and is moved towards the printing line (perpendicularly thereto) by rollers 150*a* and 150*b*.

A pressure device 155 (described in detail below) is disposed on a path of movement of the sheet of paper (continuous paper 135 or a single sheet 145) just upstream of the printing line. The pressure device 155 converges towards the platen 125 in the direction of movement of the sheet of paper 135, 145, forming with the platen 125 a lead-in dihedral which facilitates the insertion of the sheet of paper 135, 145 between the pressure device 155 and the platen 125. The sheet of paper 135, 145 is thus transported to the printing line between the head 110 (and the respective inked ribbon) and the platen 125. At the same time, the pressure device 155 holds the sheet of paper 135, 145 tightly against the platen 125 in the region of the printing line. Alternatively, the pressure device is disposed just downstream of the printing line, two pressure devices are provided (one upstream and one downstream of the printing line) etc.

The sheet of paper 135, 145 is advanced towards the printing line with an intermittent motion; each time the sheet of paper 135, 145 stops, the head 110 passes along the printing line (in the two directions alternately) so as to print several lines (of characters or of a graphic image) on the sheet of paper 135, 145 in succession. Once the sheet of paper 135, 145 has passed beyond the printing line, the sheet of paper 135, 145 is interposed between two rollers 160*a* and 160*b* which urge the sheet of paper 135, 145 towards an output slot 165.

In the particular case of a continuous module 135, upon completion of a printing operation, the printed portion is cut from the remainder of the module. The printer 100 generally has a parking mechanism which drives the rollers 160*a*, 160*b* and the pair of tractor feed devices 130 in reverse so as to retract the continuous module 135 until a free transverse edge thereof is disposed in the vicinity of the pair of tractor feed devices 130. This clears the printing line for the supply of single sheets 145 and also prevents a first sheet of the continuous module 135 from being wasted during a subsequent printing operation.

The operation of the printer 100 is controlled by a logic control unit 170 in response to commands input by a user by means of an external panel 175 or supplied by a processing system (not shown in the drawing) by means of a suitable connection cable.

The pressure device of the present invention is also suitable for use in a serial dot-matrix printer having a different structure, for example, having one or more cassettes for the automatic supply of single sheets, or a cassette for collecting the printed sheets; similar considerations apply if the printer uses different print substrates, is a daisy-wheel printer, an ink-jet printer, parallel printer, etc.

Figure 2:
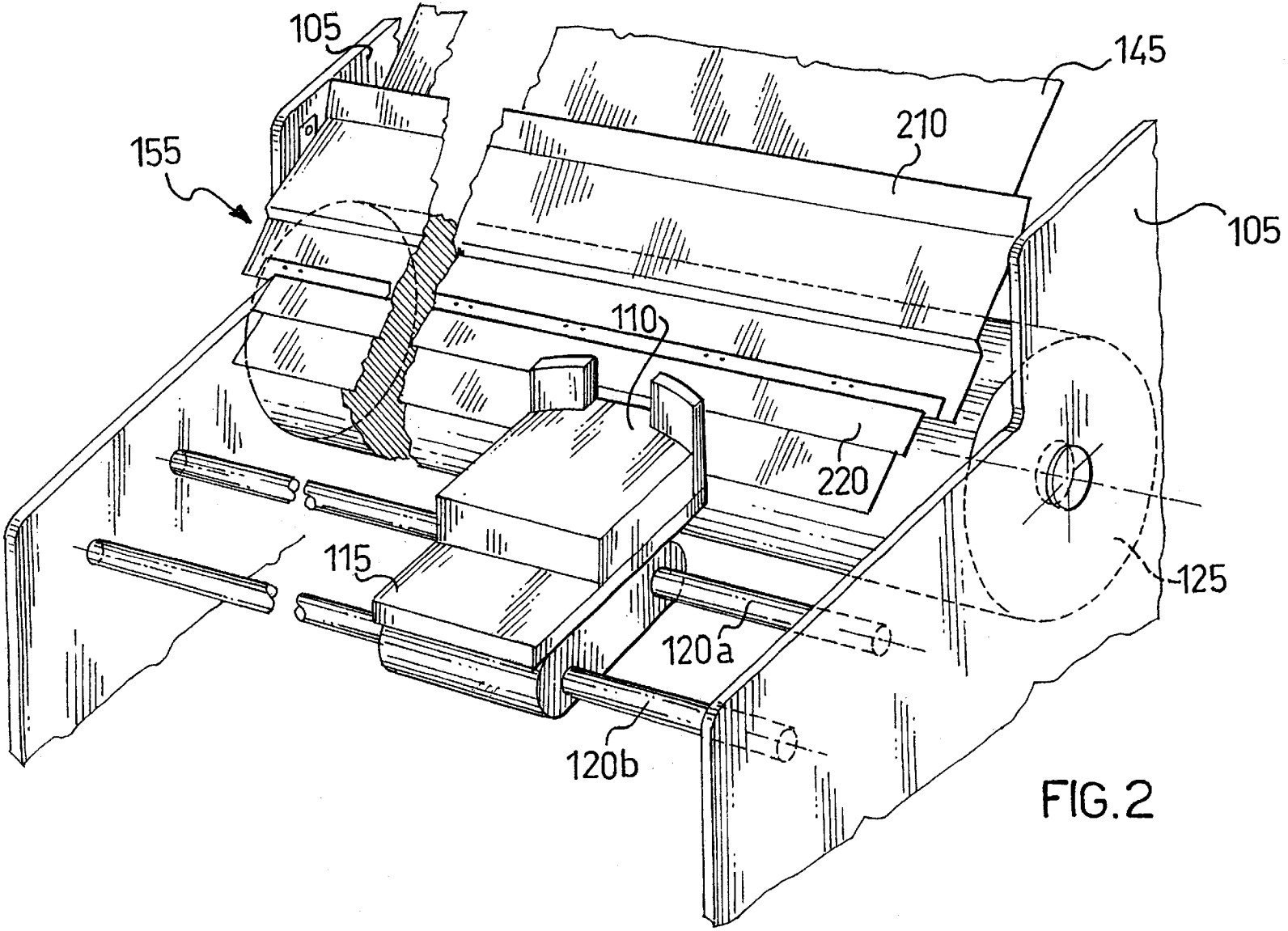
FIG. 2 is a perspective view of a detail of the printer comprising the pressure device.

With reference now to FIG. 2 (the elements already shown in FIG. 1 are identified by the same reference numerals), the pressure device 155 includes a support element 210 constituted by a suitably-shaped, pre-aluminized sheet-metal plate elongate in the direction along the platen 125. The support element 210 extends along the entire length of the platen 125 and is screwed to two sides of the frame 105. Alternatively, the support element is made of an equivalent substantially rigid material with at least one easily bent portion, is shaped differently, is fixed to the printer frame in another manner, etc.

A flexible plate 220 is connected to the support element 210. A longitudinal free edge of the flexible plate 220 is urged against the platen 125 along substantially the whole of the printing line so as to hold the printing substrate, for example, the single sheet 145 shown in the drawing, tightly against the platen 125. The flexible plate 220 is made of transparent polyester film so that the printing substrate is visible; alternatively, a different plastics material, a very thin metal sheet, or the like is used.

Figure 3:
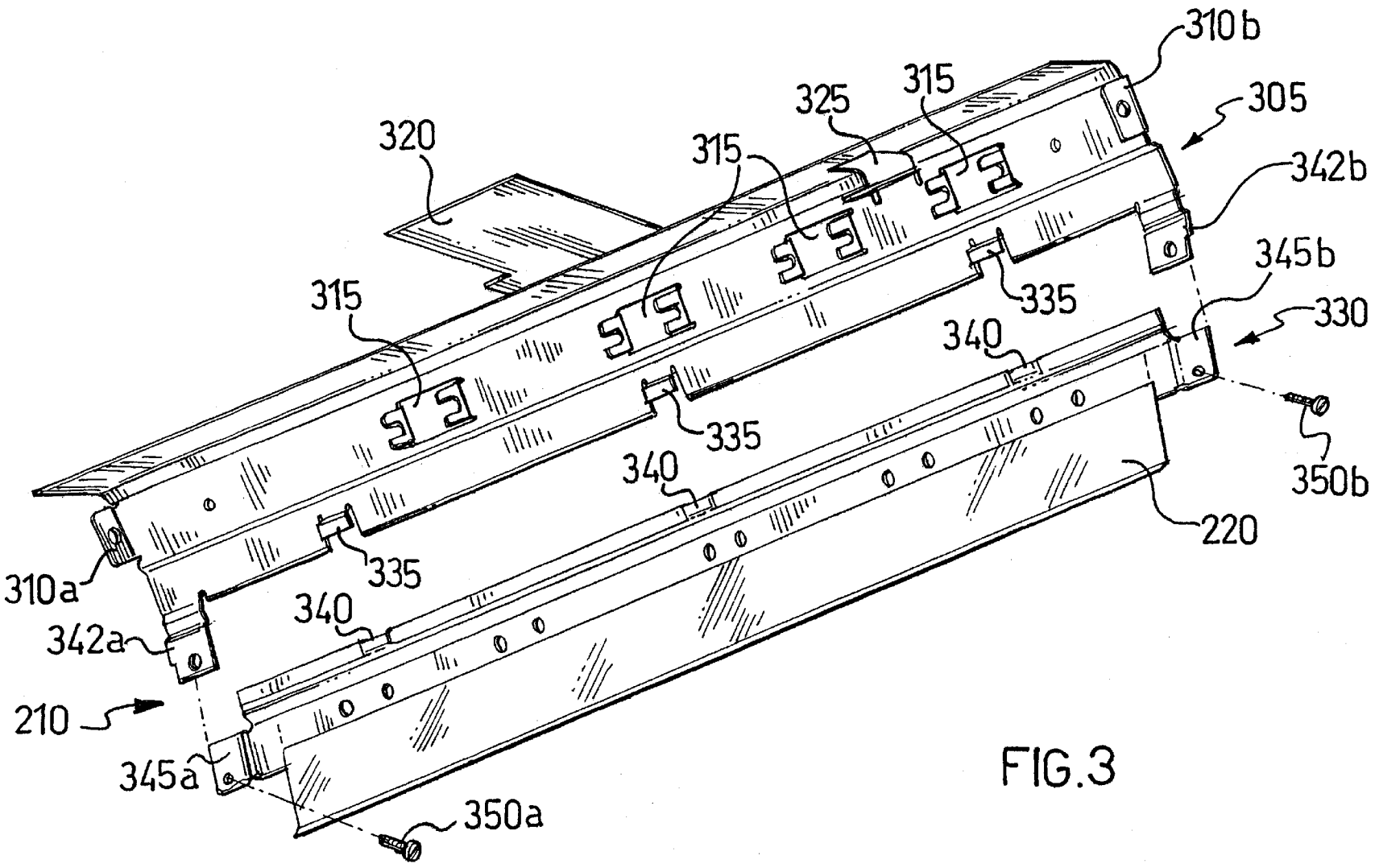
FIG. 3 is an exploded view of the pressure device.

With reference to FIG. 3 (elements already shown in FIG. 2 are identified by the same reference numerals) the support element 210 includes a fixed inner element 305 constituted by a sheet-metal plate in which longitudinal stiffening bends are formed and which has an upwardly-bent, rear side portion. Fixing brackets 310*a* and 310*b* are provided at the left-hand and a right-hand longitudinal end of the inner element 305, respectively; each bracket 310*a,* 310*b* has a threaded through-hole for housing a screw (not shown in the drawing) which enables the inner element 305 to be fixed to the printer frame.

Seats 315 (four in the embodiment shown) are provided along the inner element 305 for housing idle rollers (not shown in the drawing) for guiding single sheets. A fixing plate 320 for a cable of the head (not shown in the drawing) is welded to the centre of the rear side portion of the inner element 305. A window 325 which houses an optical paper detector (not shown in the drawing) is also formed in the vicinity of the rear side portion of the inner element 305 to the right of the fixing plate 320.

The above-described structure of the inner element 305 is particularly advantageous since it allows various functions to be concentrated in an extremely small space. Similar considerations apply if the inner element has a different structure, does not have guide rollers, a fixing plate, or paper detectors, etc.

The support element 210 also includes an intermediate element 330 to which the flexible plate 220 is connected (as described in detail below). Pairs of notches (three in the embodiment shown) extend perpendicularly from a front longitudinal edge of the inner element 305 (facing the intermediate element 330), each notch defining a tongue 335 which is bent slightly upwards. A free side 10 portion of the intermediate element 330 (the opposite side to the flexible plate 220) is pushed between the front longitudinal edge of the inner element 305 and the tongues 335. The intermediate element 330 preferably has recesses 340 fitting the tongues 335 to facilitate insertion.

Fixing tabs 342*a* and 342*b,* in each of which a threaded through-hole is formed, are provided in the vicinity of a left-hand and a right-hand end of the front longitudinal edge of the inner element 305, respectively. Matching tabs 345*a,* 345*b* are disposed on the longitudinal ends of the intermediate element 330; each tab 345*a,* 345*b* has a through-hole (corresponding to the threaded through-holes) of the tabs 342*a,* 342*b*) which is slightly elongate to compensate for any errors of alignment between the inner element 305 and the intermediate element 330. The tabs 345*a,* 345*b* are superimposed on the tabs 342*a,* 342*b* so that the corresponding holes are aligned with one another in order to house respective screws 350*a,* 350*b* which fix the intermediate element 330 to the inner element 305.

This solution is extremely advantageous since it enables maintenance operations to be performed on the pressure device quickly and easily. The flexible plate is in fact subject to frequent breakage or bending, for example, because of jamming of the sheet of paper, involving the need to replace the pressure device. In known printers, this operation requires the removal of the guide bars of the sliding carriage which supports the printing head. Once the pressure device has been replaced, the guide bars are re-fitted. During this stage it is necessary to check that the guide bars and the printing line (defined by the platen) are precisely parallel; the error in parallelism must in fact be kept within quite narrow limits of the order of 5–7 hundredths to ensure correct operation of the printer. The whole operation to replace the pressure device generally takes 30–40 minutes.

In the solution described above, on the other hand, it suffices to retract the printing head (by a few millimetres), utilizing, for example, the function of a mechanism which is provided in many printers for automatically regulating the distance of the head from the platen to permit printing on substrates of different thicknesses. The intermediate element 330 is unscrewed from the inner element 305 and then simply pulled out. The same operations are performed in reverse in order to re-fit the intermediate element 330. This permits replacement of the intermediate element of the pressure device alone; the entire replacement operation takes a few minutes with a saving in time of the order of 90%.

The particular structure of the inner element and of the intermediate element is also extremely simple from a production point of view. Alternatively, the intermediate element is connected to the inner element with screws disposed in different positions, or a snap system or other equivalent means are used to fix the intermediate element releasably to the inner element. The present invention may in any case also be implemented with a support element which cannot be split up (without the intermediate element).

Figure 4:
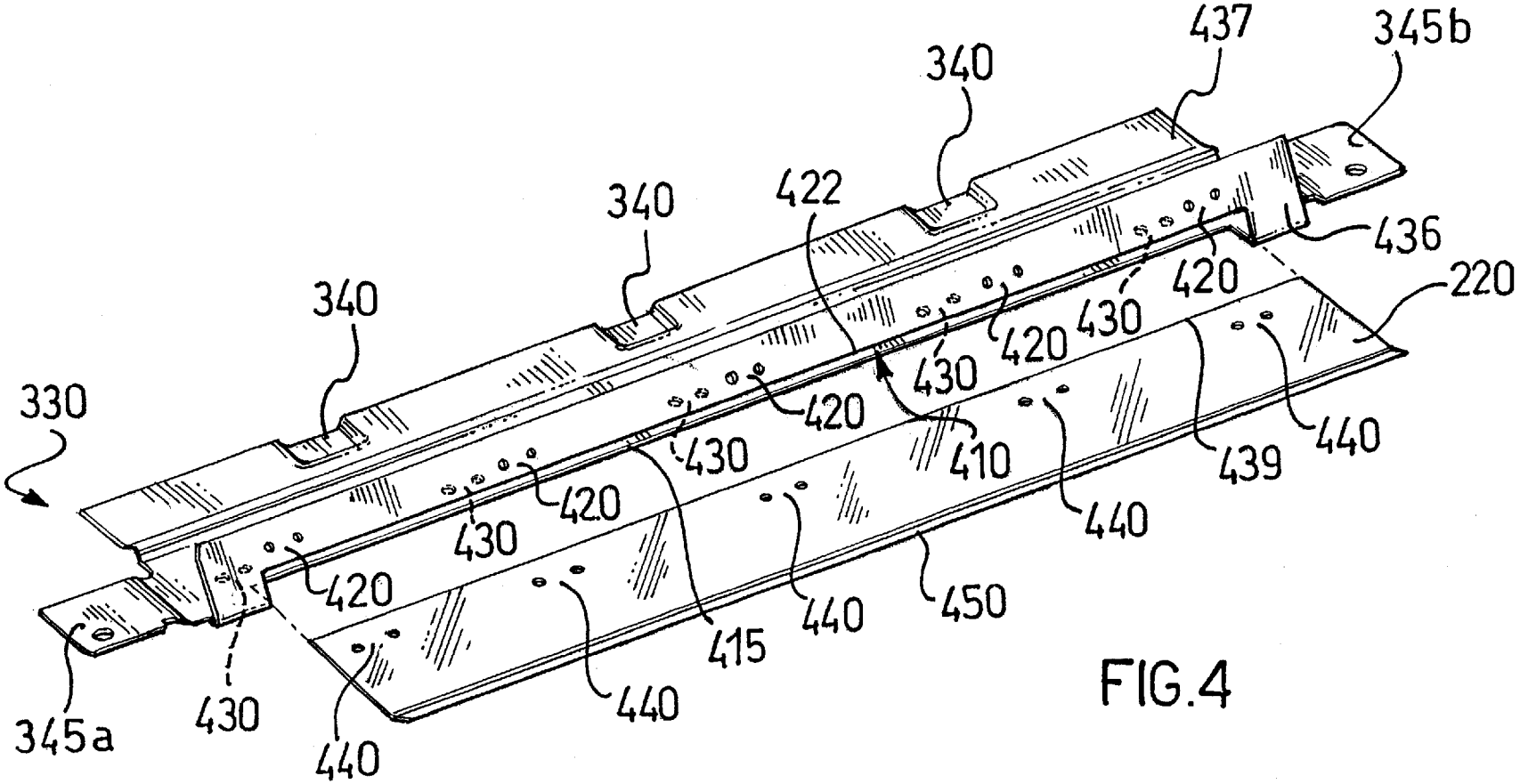
FIG. 4 shows the intermediate element of the pressure device with parts separated.

With reference now to FIG. 4 (elements already shown in FIG. 3 are identified by the same reference numerals), the intermediate element 330 is constituted by a sheet-metal strip. The sheet-metal strip is subjected to a bending process in which longitudinal stiffening bends which give the strip a generally Z-shaped profile are formed, in addition to the recesses 340 and the tabs 345*a,* 345*b*.

At the front of the strip 330, a window 410 extending longitudinally up to the vicinity of the left-hand and right-hand ends of the strip 330 is formed, for example by blanking. A lower corner of a longitudinal inner edge 415 of the window 410 (facing the platen in a condition of use of the pressure device) is preferably chamfered, for example at 45°; this creates a rounded surface which facilitates the passage of the sheet of paper and makes reverse movement of the continuous module easier.

At the same time, the through-holes are formed in the tabs 345*a,* 345*b* and a series of upwardly-projecting dimples 420 is formed. The dimples 420 (ten arranged in pairs in the embodiment shown) are arranged along an outer longitudinal edge 422 of the window 410; corresponding holes 430 are formed along the inner longitudinal edge 415 of the window 410. Similar considerations apply if there is a different number of dimples (and corresponding holes), if the dimples and the corresponding holes are arranged in a different manner, or are formed in a reversed arrangement on the inner edge and on the outer edge of the window, respectively, etc.

A front portion 436 of the strip 330 comprising substantially half of the width of the window 410 is bent upwardly beforehand so as to be inclined at an angle of 45° (or, more generally, an angle of less than 90°) to a remaining portion 437 of the strip 330 to facilitate a final bending operation (described below).

The strip 330 is then placed on a work surface of a press (not shown in the drawing) in which there is a series of conical pins which are fitted in the holes 430 in order to keep the strip 330 in position. A side portion of the flexible plate 220 disposed along an inner longitudinal edge 439 is inserted in the window 410; a series of holes 440 corresponding to the holes 430 is formed in the vicinity of the inner longitudinal edge 439 and these are fitted on the conical pins. An outer longitudinal edge of the flexible plate 220 preferably also has an upwardly-facing lip 450 which facilitates the insertion of the continuous module between the pressure device and the platen during its movement in reverse.

At this point, the front portion 436 is bent fully (by means of the press) onto the remaining portion 437 so as to define a turned-over portion which restrains the side portion of the flexible plate 220 disposed along the inner longitudinal edge 439. In particular, the front longitudinal edge 422 is superimposed substantially on the rear longitudinal edge 415; the front portion 436 of the strip 330 covers the remaining portion 437 only partially, leaving free the side portion in which the recesses 340 are formed. At the same time, the dimples 420 are fitted in the corresponding holes 440 and 430 until they project below the strip 330. The dimples 420 are then subjected to an upsetting operation which fixes the dimples 420 in the corresponding holes 430; each dimple 420 is preferably upset in a manner such as not to project below the strip 330 in order not to obstruct the passageway for the sheet of paper.

The above-described structure is particularly advantageous since it enables the flexible plate to be fixed to the support element very easily and without interfering with the system for connecting the intermediate element to the inner element. Alternatively, two lateral arms extend from a main body of the strip and are bent onto the main body in order to restrain a portion (which may not even be a side portion) of the flexible plate, the strip is bent fully onto itself along a longitudinal axis thereof so that the flexible plate projects from the superimposed longitudinal edges of the strip, etc. More generally, in the pressure device according to the present invention, the support element includes a turned-over portion bent onto a remaining portion of the support element in order to restrain a portion of the flexible plate.

The pressure device of the present invention can be produced extremely easily. In particular, the production process of the pressure device can easily be automated so that the pressure device can be mass-produced at low cost.

The pressure device is very strong; the flexible plate in fact remains firmly connected to the support element even when subjected to quite large forces in use.

Moreover, the method of production of the pressure device according to the present invention is particularly environmentally favourable since it does not use glue or solvent of any type.

The fixing system formed by the dimples 420 and by the corresponding holes 430 ensures optimal mechanical retention of the flexible plate whilst being very simple. In alternative embodiments, fixing eyes, spot welding formed by two heating electrodes, or other equivalent means are used to fix the side portion of the flexible plate between mutually facing surfaces of the turned-over portion and of the remaining portion of the support element.

The present invention may, however, also be implemented without such fixing means. For example, if the pressure device is used in a printer with a slow printing speed so that the flexible plate is subject to forces of limited intensity, the pressure exerted between the mutually facing surfaces of the turned-over portion and of the remaining portion of the strip is sufficient to restrain the flexible plate; in this case, the end portions of the strip (in which the window is not provided) are kept larger so as to improve the grip on the flexible plate.

Naturally, in order to satisfy contingent and specific requirements, an expert in the art may apply to the above-described pressure device for a printer many modifications and variations all of which, however, are included within the scope of protection of the invention as defined by the following claims.

What is claimed is:

1. A pressure device for a printer comprising a support element which is fixed to a frame of the printer, wherein the printer includes (i) a platen mounted on the frame and (ii) a printhead mounted on the frame and moveable parallel to the platen to define a printing line on the platen, and a flexible plate fixed to the support element in order to press a printing substrate against the platen in the vicinity of the printing line, wherein the support element includes a turned-over portion substantially parallel to the platen which is bent onto a remaining portion of the support element in order to restrain a portion of the flexible plate.

2. A pressure device for a printer comprising a support element which is fixed to a frame of the printer and a flexible plate fixed to the support element in order to press a printing substrate against a platen in the vicinity of a printing line, wherein the support element includes a turned-over portion which is bent onto a remaining portion of the support element in order to restrain a portion of the flexible plate in which a window disposed partly in the turned-over portion and partly in the remaining portion is formed in the support element, a side portion of the flexible plate disposed along a longitudinal edge being inserted in the window.

3. A pressure device according to claim 2, in which the window has a first longitudinal edge and a second longitudinal edge disposed substantially one above the other.

4. A pressure device according to claim 3, in which a corner of one of the first and second edges of the window facing the platen in a condition of use of the pressure device is chamfered to facilitate the passage of the printing substrate.

5. A pressure device according to claim 2, in which the turned-over portion covers the remaining portion of the support element only partially.

6. A pressure device according to claim 2, further comprising means for fixing the side portion of the flexible sheet between mutually facing surfaces of the turned-over portion and of the remaining portion of the support element.

7. A pressure device according to claim 6, in which the fixing means include a plurality of dimples formed along the first edge of the window, a plurality of corresponding holes formed along the second edge of the window, and a plurality of further corresponding holes formed along the longitudinal edge of the flexible plate, each dimple being inserted in the corresponding hole and further hole and being upset on the corresponding hole.

8. A pressure device for a printer comprising a support element which is fixed to a frame of the printer and a flexible plate fixed to the support element in order to press a printing substrate against a platen in the vicinity of a printing line, wherein the support element includes a turned-over portion which is bent onto a remaining portion of the support element in order to restrain a portion of the flexible plate, in which the support element includes an inner element which is fixed to the frame, an intermediate element to which the flexible plate is fixed, and means for fixing the intermediate element releasably to the inner element.

9. A pressure device according to claim 8, in which a plurality of pairs of notches, each defining a tongue, extend from a longitudinal edge of the inner element facing the intermediate element, a free side portion of the intermediate element facing away from the flexible plate being pushed between the longitudinal edge of the inner element and the tongues.

10. A pressure device according to claim 9, in which a plurality of recesses fitting the tongues is formed along the free side portion of the intermediate element to facilitate the insertion of the intermediate element.

11. A pressure device according to claim 9, in which the inner element has a first tab and a second tab extending from a first end and from a second end of the longitudinal edge, respectively, and in which the releasable element has a corresponding first further tab and a corresponding second further tab, each tab and the further tab being superimposed and screwed together.

12. A printer comprising a frame, a platen mounted on the frame, at least one pressure device having a support element which is fixed to the frame, a printhead mounted on the frame and moveable parallel to the platen to define a printing line on the platen, and a flexible plate fixed to the support element in order to press a printing substrate against the platen in the vicinity of the printing line, wherein the support element includes a turned-over portion substantially parallel to the platen which is bent onto a remaining portion of the support element in order to restrain a portion of the flexible plate.

13. A method of producing a pressure device for a printer comprising the steps of:

providing a support element which is fixed to a frame of the printer, providing a printhead mounted on the frame and moveable parallel to a platen to define a printing line on the platen, and fixing to the support element a flexible plate for pressing a printing substrate against a platen in the vicinity of a printing line, wherein the fixing step comprises bending of a turned-over portion of the support element onto a remaining portion of the support element in a resultant orientation substantially parallel to the platen in order to restrain a portion of the flexible plate.

14. A method of producing a pressure device for a printer comprising the steps of:

providing a support element which is fixed to a frame of the printer, fixing to the support element a flexible plate for pressing a printing substrate against a platen in the vicinity of a printing line, wherein the fixing step comprises bending of a turned-over portion of the support element onto a remaining portion of the support element in order to restrain a portion of the flexible plate, forming a window disposed partly in the turned-over portion and partly in the remaining portion of the support element, and inserting a side portion of the flexible plate disposed along a longitudinal edge in the window.

* * * * *